United States Patent [19]

Janson

[11] 3,979,576

[45] Sept. 7, 1976

[54] ELECTRIC HEATING ELEMENT CONTROL CIRCUIT

[76] Inventor: Sven-Olof Janson, Svarvaregatan 6, Halmstad, Sweden, 30250

[22] Filed: May 28, 1974

[21] Appl. No.: 474,077

[30] Foreign Application Priority Data

June 14, 1973 Sweden ..... 7308360

[52] U.S. Cl. ..... 219/489; 219/321; 219/364; 219/483

[51] Int. Cl.[2] ..... H05B 1/02

[58] Field of Search ..... 13/24; 219/364, 376, 219/365, 378, 341, 320, 321, 375, 483–487, 489, 491

[56] References Cited

UNITED STATES PATENTS

| | | | |
|---|---|---|---|
| 1,875,236 | 8/1932 | Hall | 219/364 |
| 3,482,195 | 12/1969 | Jansson | 219/364 UX |
| 3,892,946 | 7/1975 | Rimmi | 219/483 X |

FOREIGN PATENTS OR APPLICATIONS

| | | | |
|---|---|---|---|
| 994,912 | 8/1951 | France | 219/365 |

*Primary Examiner*—A. Bartis
*Attorney, Agent, or Firm*—Holman & Stern

[57] ABSTRACT

A circuit for connecting to an alternating current electric network having at least one phase a high-power electric heating device, such as a sauna heater, provided with a plurality of electric heating elements. Each phase of the network is evenly divided into a number of separate part leads such that the total number of part leads are arranged in two equal series. A first switch is arranged to simultaneously open and close all of the part leads of both series. A second multipolar switch controlled by a thermostat is adapted to open at least one of the separate part leads of one of the series. Each heating element is connected in circuit with one part lead from each series of part leads. The network may be three phase with the heating elements being delta-connected.

2 Claims, 2 Drawing Figures

ELECTRIC HEATING ELEMENT CONTROL CIRCUIT

BACKGROUND OF THE INVENTION

The present invention relates to an electric circuit for connecting an electric heating apparatus, particularly a sauna apparatus having a number of electric heating elements to the electric network.

At earlier circuits of this kind a thermostatically controlled contactor has been located at the input of the control panel, the phases of the wire network thereupon in a convenient manner have been connected to the heating elements of the apparatus. This means that the contactor will cut out all phases when the ambient temperature reaches the value set at the thermostat. Due to the high current strength generally used at apparatuses of this kind it is necessary to use coarse switches and a powerful contactor, which means that the switching operations for connecting and disconnecting the heating elements will cause very loud blow sounds. The cross-sectional area of the wires in the control panel must further be coarse due to the high amperage of the feed current.

SUMMARY OF THE INVENTION

The purpose of the present invention is to provide a circuit of the kind referred to, at which circuit the above mentioned drawbacks are minimized and this is achieved through the invention thereby that the phases of the electric network are evenly branched off into part leads of a number twice the number of heating elements, that a first switch is adapted simultaneously to act upon all part leads, that each part lead of a first series of part leads is connected to one terminal pole of a heating element each, that a second, thermostatic controlled, multi-polar switch is fitted in the said first series of part leads that said multipolar switch is arranged to cut out one or more heating elements in response to impulses from the thermostat, and that each separate part lead of a second series of part leads is connected directly to the second terminal pole of each one of the heating elements.

DESCRIPTION OF THE PREFERRED EMBODIMENTS

Figure 1:
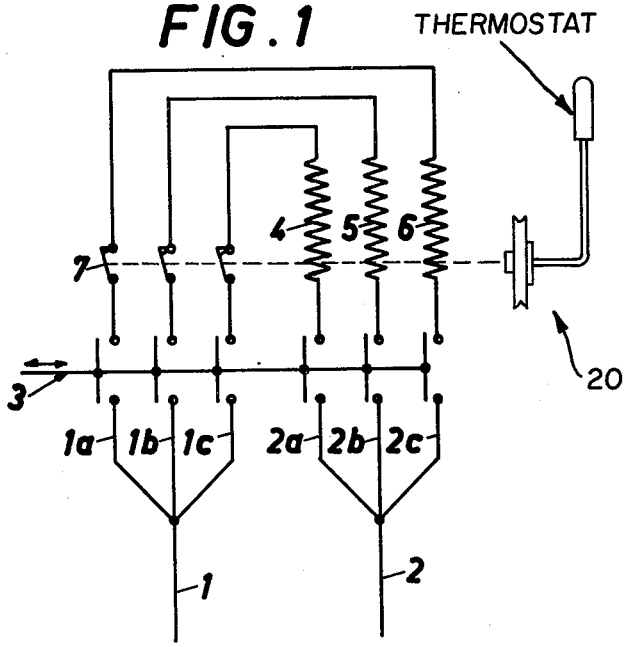
FIG. 1 shows schematically a circuit according to the invention applied at a single phase apparatus.

In FIG. 1 it is shown how each of two leads 1 and 2 of a single phase network is branched off to three part leads 1*a*, 1*b*, 1*c* and 2*a*, 2*b*, 2*c* resp. A six-polar switch 3, or two three-polar switches which can be connected by means of a common lever, is adapted simultaneously to cut out or to close all part leads.

One of the two series of part leads 2*a*, 2*b* and 2*c* continues behind the switch 3 directly to one terminal pole of one heating element 4, 5 and 6 resp. whereas in the other series of part leads 1*a*, 1*b* and 1*c* there is arranged a three-polar thermostatic switch 7 having split switching-off function, thus that one or more of the three part leads 1*a*, 1*b* and 1*c* automatically can be cut out according to the actual need. These part leads 1*a*, 1*b* and 1*c* continue behind the thermostatic switch 7 to the other terminal pole of the elements 6, 5 and 4, resp. The thermostatic control 20 for switch 7, is of conventional design.

Figure 2:
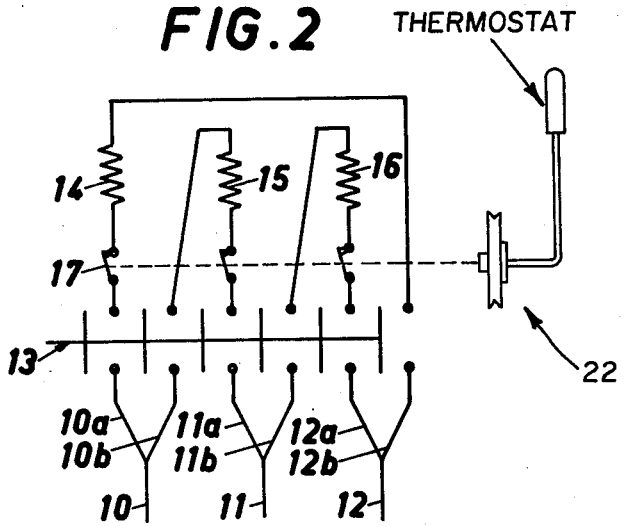
FIG. 2 is a corresponding scheme applied at a three phase apparatus.

At the three-phase connection shown in FIG. 2 each of the three phases 10, 11 and 12 is divided into two part leads 10*a*, 10*b*; 11*a*, 11*b* and 12*a*, 12*b* resp. A switch 13 is fitted behind the branching points and this switch is adapted simultaneously to cut out or to close all part leads. As in the single phase apparatus described hereabove a series of part leads 10*b*, 11*b* and 12*b* thereupon is connected to one of the terminal poles of the heating elements 15, 16 and 14 resp., whereas a three-polar thermostatic switch 17 is fitted in the other series of part leads, said switch being of the type adapted to cut out one or more of the part leads 10*a*, 11*a* and 12*a* if so required. The thermostatic control 22 for switch 17, is of conventional design.

In the embodiment of FIG. 2 the heating elements are delta-connected to the network.

The circuit described hereabove provides for a power division which means that it is possible at the control portion of the apparatus, to work with a current strength being only one third of that at a conventional circuit without power division.

The present circuit which, as can be seen, is equally suited for single phase apparatuses and three-phase apparatuses, renders it possible to use a thermostat with a split switching off function i.e. one of the thermostat contacts cuts out at a temperature being 2°–4°C higher than the set value whereas the two remaining contacts cut out only if the temperature raises further above said value. Due to the fact that the amperage will be low as compared to earlier circuits, the contactors need not be as forceful and the loud blow sounds are thereby reduced.

The invention is not limited to the embodiments shown and described in connection to the accompanying drawing but modifications are possible within the scope of the appended claims.

What I claim is:

1. An electric heating circuit for connecting an electric heating apparatus, to a source of power comprising a plurality of heating elements, an alternating current electric network having at least one phase, each phase of the network being evenly divided into a number of part leads, the total number of part leads being twice the number of heating elements; said part leads being arranged into two series of part leads each comprising as many part leads as the number of heating elements in the apparatus; a first switch means being arranged simultaneously to close and open all part leads of both of said series; each separate part lead of a first one of said series being connected to one separate terminal pole of a respective one of the said heating elements; a second multipolar switch being disposed in said first series of part leads, said second switch being controlled by a thermostat and adapted to open at least one of the separate part leads of the said first series, thereby disconnecting at least one associated heating element in response to impulses from the thermostat; each separate part lead of the second series of part leads being directly connected to the corresponding other terminal pole of a respective one of the heating elements.

2. The electric circuit as defined in claim 1, wherein said plurality of heating elements is evenly divisible by three and all said heating elements are delta-connected to the electric network.

* * * * *